US011554836B2

(12) United States Patent
Riem et al.

(10) Patent No.: US 11,554,836 B2
(45) Date of Patent: Jan. 17, 2023

(54) PASSAGE ASSIST RAILING FOR BOAT

(71) Applicant: Leisure Properties LLC, West Frankfort, IL (US)

(72) Inventors: Kevin Riem, West Frankfort, IL (US); Evan Forbes, West Frankfort, IL (US)

(73) Assignee: Leisure Properties LLC, West Frankfort, IL (US)

( * ) Notice: Subject to any disclaimer, the term of this patent is extended or adjusted under 35 U.S.C. 154(b) by 94 days.

(21) Appl. No.: 17/323,966

(22) Filed: May 18, 2021

(65) Prior Publication Data

US 2022/0371696 A1 Nov. 24, 2022

(51) Int. Cl.
*B63B 27/00* (2006.01)
*B63B 3/54* (2006.01)

(52) U.S. Cl.
CPC ..... *B63B 27/00* (2013.01); *B63B 3/54* (2013.01)

(58) Field of Classification Search
CPC ..... B63B 27/00; B63B 3/54
USPC ..... 114/362, 364, 201 R
See application file for complete search history.

(56) References Cited

U.S. PATENT DOCUMENTS 4,829,926 A * 5/1989 Voelkel ..... B63B 7/02 114/352
10,994,810 B1 * 5/2021 Scheele ..... B63B 17/04

* cited by examiner

*Primary Examiner* — Daniel V Venne
(74) *Attorney, Agent, or Firm* — Stinson LLP

(57) ABSTRACT

A passage assist provides a temporary support to stabilize passage of a person over a surface, such as in a boat. The passage assist can be a fold down railing that in a deployed position presents a handle or railing in a location to be easily grasped by a person walking on the adjacent surface, such as the deck of a boat. In a collapsed or stowed position, the fold down railing can be positioned completely out of the way so that it provides no impediment or barrier to movement on the surface. In the case of a boat, the fold down railing does not permanently occupy precious space within the boat.

20 Claims, 10 Drawing Sheets

PASSAGE ASSIST RAILING FOR BOAT

FIELD

The present disclosure generally relates to entryway/passageway stabilization assistance for boats.

BACKGROUND

Boats are common and popular recreational vehicles, allowing users to navigate waterways and engage in water-sports. Care must be taken when entering and exiting a boat, because one is moving between a stationary object (e.g., a dock) to a moving object (e.g., the boat). Boats and in particular boats used for recreation and other personal use may be constructed for entry at different locations. Some locations may naturally have more structure for holding onto as one enters or exits the boat or traverses from one boat to another or from one part of the boat to another part.

SUMMARY

In one aspect, a passage for a boat generally comprises a shell sized and shaped to cover at least a portion of the boat that is positioned to be traversed by passengers of the boat, the shell including a recess located formed in the shell. A fold down railing comprising at least one baluster and a handle mounted on the end of the baluster. The baluster is pivotable with respect to the shell between a deployed position in which the baluster projects out of the recess and locates the handle above the shell in a position for grasping by a person walking on the boat, and a stowed position in which the baluster and handle are disposed in the recess.

In another aspect, a fold down railing for selective deployment to stabilize passage over a surface generally comprises a base configured to be mounted on a boat. The base is channel-shaped. A first baluster is pivotally connected to the base at a first location, and a second baluster is pivotally connected to the base at a second location spaced apart from the first location. A handle is pivotally connected at one end to the first baluster and at another end to the second baluster. A brace is pivotally connected to the first baluster at a first end and connected to the base at an opposite, second end for pivoting and sliding with respect to the base. The first baluster, second baluster and handle are selectively movable from a stowed position in which the handle is located close to the base and a deployed position in which the handle is farther from the base. The second end of the brace slides along the base as the first baluster, second baluster and handle move between the stowed and deployed position. A releasable stop can lock the brace against sliding movement along the base thereby to hold the first baluster, second baluster and handle in the deployed position.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
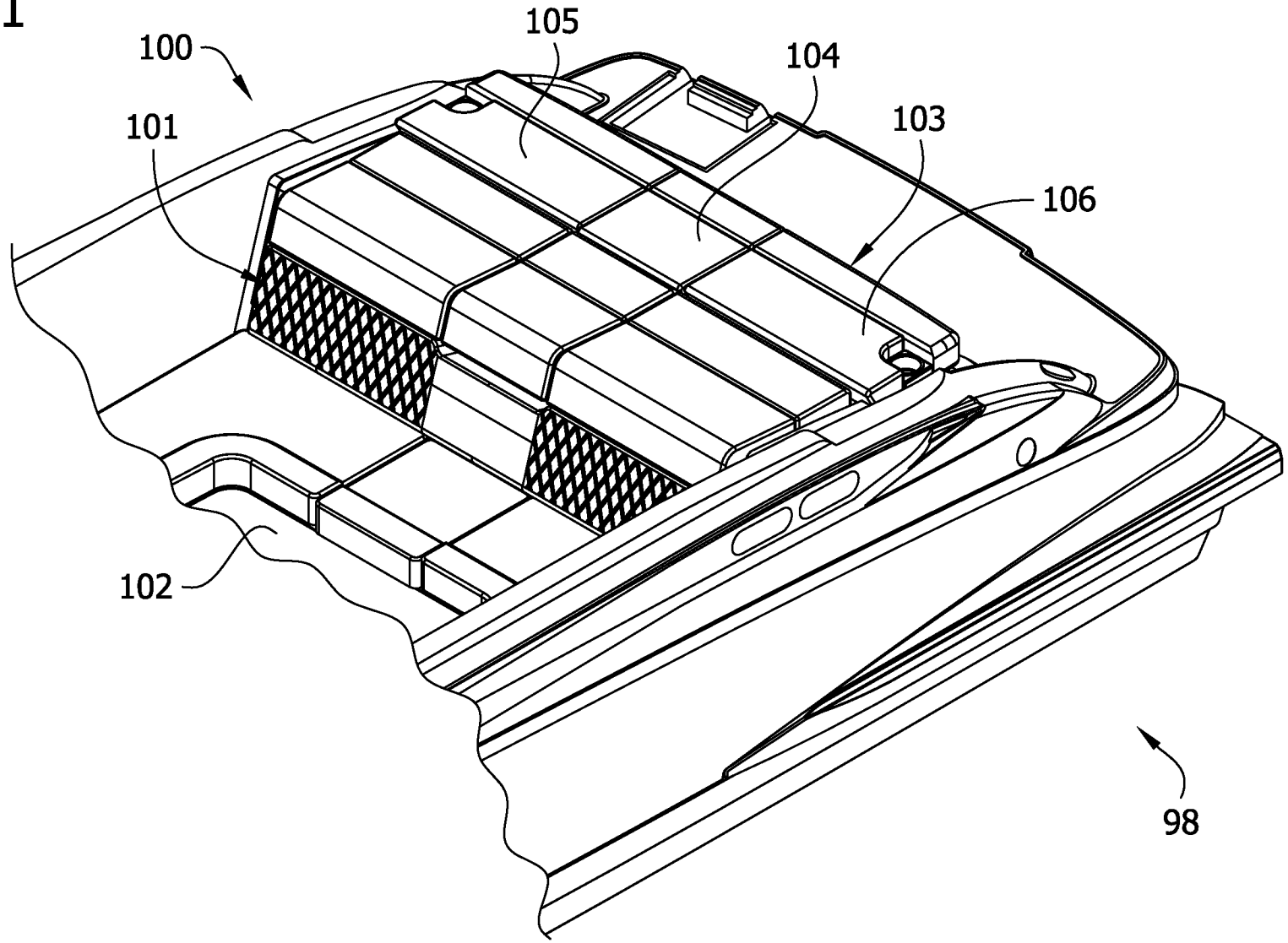
FIG. 1 is a fragmentary perspective of a stern of a boat having an entryway and seating structure.
Figure 2:
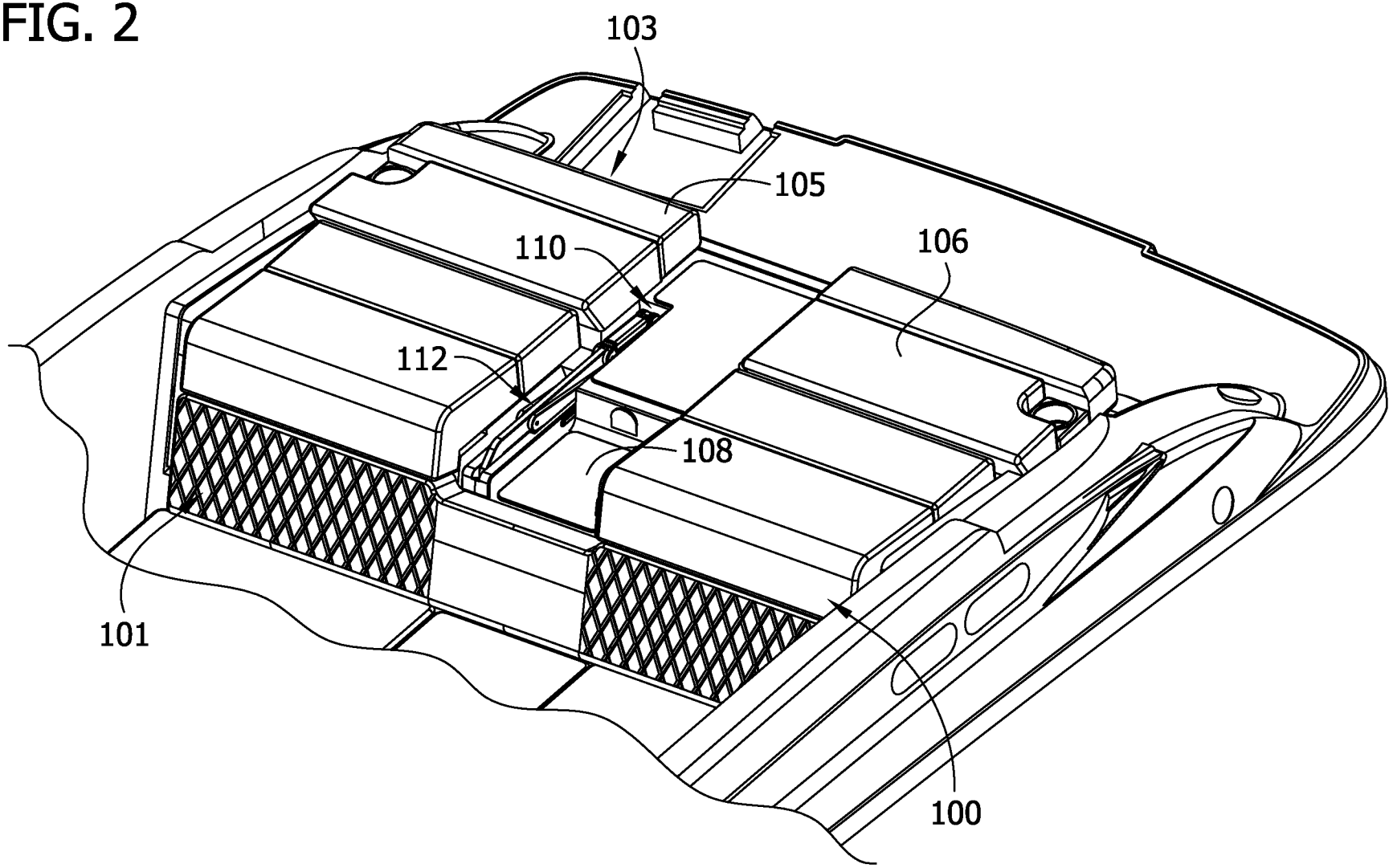
FIG. 2 is an enlarged perspective of the stern of the boat with a shell covering removed to show an integrally formed step and a collapsible, entryway assist railing in a stowed position.
Figure 3:
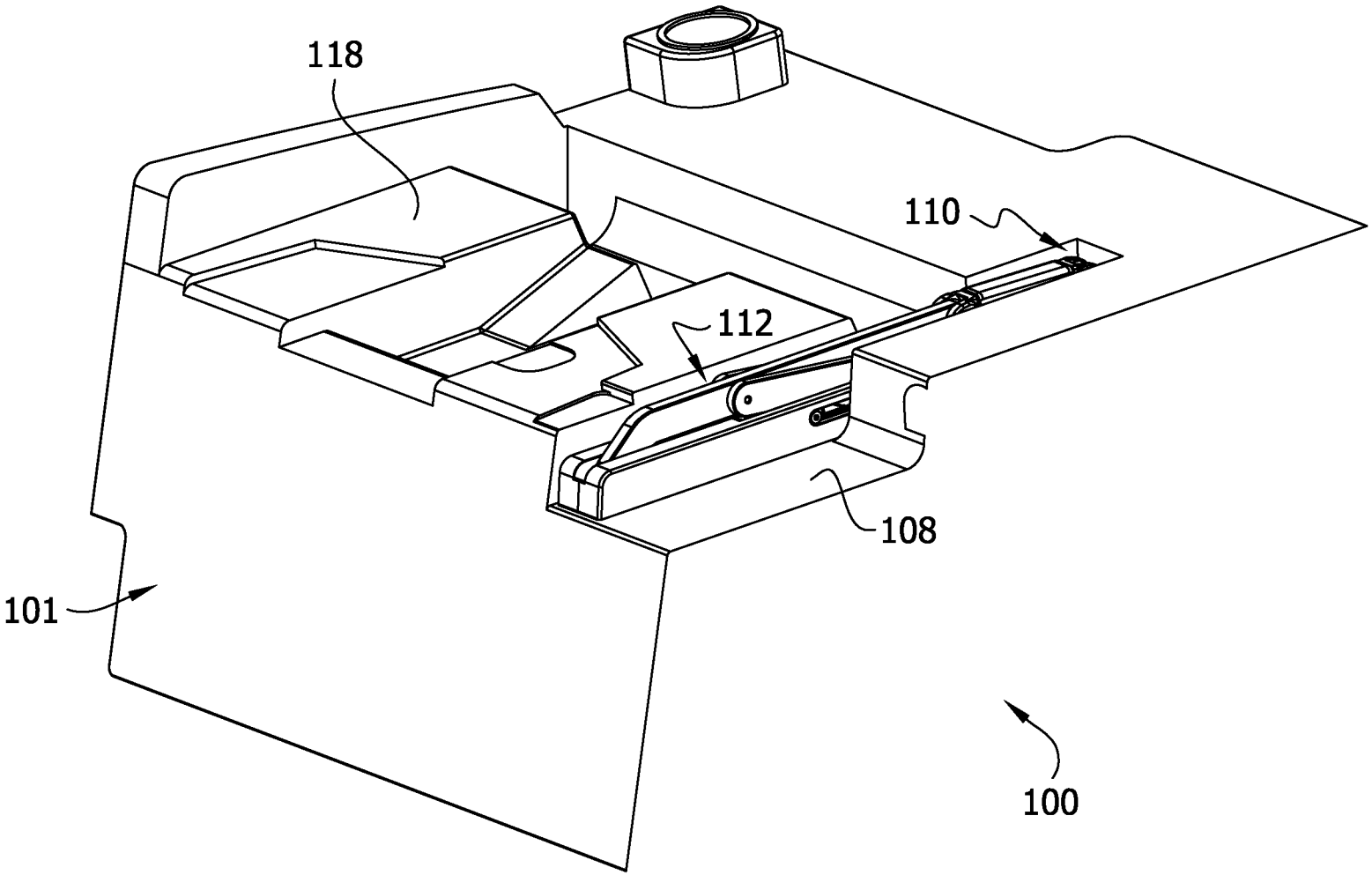
FIG. 3 is a fragmentary perspective of the entryway showing the entryway assist railing in the stowed position.

Referring to FIG. 1, a passage or entryway in the form of a motor cover 100 for covering a motor of a rear-entry boat 98 is shown. The motor cover 100 comprises a shell 101, the shell sized and shaped to cover at least a portion of an opening on the boat at the rear of the boat. The shell 101 is positioned to provide access from a deck 102 of the boat to the motor (not shown). The motor cover 100 comprises a shell covering 103, the covering including a middle covering element 104, a left covering element 105, and a right covering element 106. The shell covering 103 is configured to overlie the shell 101. In the illustrated embodiment, the covering elements 104, 105, 106 include seat cushions and floor panels suitable for walking and/or sitting upon, and will be understood to be an optional feature. It will be understood that within the scope of the present invention, the passage may not cover the boat's motor, or constitute an entryway of the boat.

Referring to FIGS. 2-5, the shell 101 further comprises an integrally formed step 108 and an integrally formed recess 110 located proximate to the integrally formed step. The middle portion 104 of the shell covering 103 overlies the integrally formed step 108 and is selectively removable by the user to allow access to the integrally formed step, for example when passengers are entering or exiting the boat. The motor cover 100 further comprises an entryway assist or fold down railing 112 (generally, a railing) comprising a first baluster 113, a second baluster 114 and a handle 116 mounted on the top ends of the balusters. It will be understood that the number of balusters may be greater or fewer than two within the scope of the present invention. The first and second balusters 113, 114 are pivotable with respect to the shell 101 between a deployed position (shown in FIGS. 4 and 5) and a stowed position (shown in FIGS. 2 and 3). In the deployed position, the railing 112 projects out of the recess 110 and locates the handle 116 above the shell 101 in a position for grasping by a person walking up or down the integral step 108. In the stowed position, the first and second balusters 113, 114 and handle 116 are generally received in the recess 110. The shell 101 has an upper surface 118 on which the shell covering 103 rests. Preferably, the collapsible or fold down railing 112 is configured such that no portion of the fold down railing 112 (i.e., the first and second balusters 113, 114 or the handle 116) projects out of the recess 110 above the upper surface 118 of the shell 101 in the stowed position. However, it is envisioned that some portion of the railing 112 may project above the upper surface 118 of the shell 101 in the stowed position. Moreover, it will be appreciated that the recess may be defined in other ways (not shown), such as by a hole in the shell.

Referring to FIGS. 6-10, the fold down railing 112 is shown separated from the motor cover 100. In the illustrated embodiment, the fold down railing 112 further includes a brace 115 and a base 117. The handle 116 is pivotally connected to and spans between the first baluster 113 and the second baluster 114. The brace 115 comprises a left brace member 130 and a right brace member 132. The left and right brace members 130 and 132 sandwich the first and second balusters 113, 114 between them. The rear ends of the brace members 130, 132 are attached to the first baluster by a pin 129 at a pivot connection. The brace 115 is not directly connected to the second baluster 114 so that the brace can rotate and translate with respect to the second baluster.

The base 117 of the fold down railing 112 comprises a channel 134, a stop housing 140, and a stop 122 slidably received in the stop housing. The channel 134 comprises side walls 137 and slots 138 in the side walls. The first and second balusters 113, 114, handle 116 and the base 117 form a parallelogram linkage. The stop 122 is generally shaped as a cube, but with a top, rearward corner having a beveled shape. The channel 134 is configured to receive a second end of the brace 115 opposite the pivot connection to the first baluster 113 (a first end of the brace) at a pivot connection in the slots 138. Thus, the second end of the brace 115 is connected by a pin 139 that can slide along the slots 138 and the brace can pivot with respect to the channel 134 at its connection in the slots to allow the fold down railing 112 to be moved between the deployed position and the stowed position.

A release slide 120 projects out of an elongate opening 136 in the middle of the second baluster 114. A cable actuator 124 extends through the center of the second baluster 114, through an opening in the base 117, and into an opening in the stop housing 140 where it connects to the stop 122. In an embodiment of the disclosure, the cable actuator 124 may be encased by a sheath. A spring 126 at the end of the retention cable 124 within the stop housing 140 biases the stop 122 to a position out of the stop housing 124 and into the channel 134 between the side walls 137. As may be seen in FIG. 9, in this position the stop 122 blocks movement of the brace 115 and thereby holds the fold down railing 112 in the deployed position.

The fold down railing 112 can be moved from the deployed position (FIGS. 6-9) to the stowed position (FIG. 10) by first moving the release slide 120 upward in the elongate opening 136 toward the handle 116. This movement causes the cable actuator 124 to pull the stop 122 downward within the stop housing 140 against the bias of the spring 126. It will be understood that it is also possible to push the stop 122 down manually. It will be appreciated that this action also compresses the spring 126, increasing the upward force being applied to the stop 122. By grasping the handle 116 (or some other designated part of the fold down railing 112), the railing can be pushed in a rearward direction. As noted above, the stop 122 does not block sliding movement of the second end of the brace 115 to the rear in the slots 138. Instead, the first and second balusters 113, 114 pivot on their connections to the channel 134 to the rear and downward. At the same time, the second end of the brace 115 slides over the top of the retracted stop 122 and to the rear of the channel 134. As may be seen in FIG. 3, the fold down railing 112 is able to move into the recess 110 in the motor cover 100. The brace members 130, 132 of the brace 115 are formed with recesses 142 so that rounded portions of the handle 116 connected to the first baluster 113 can be partially received in respective ones of the recesses to facilitate a low profile fold down of the railing 112.

Figure 4:
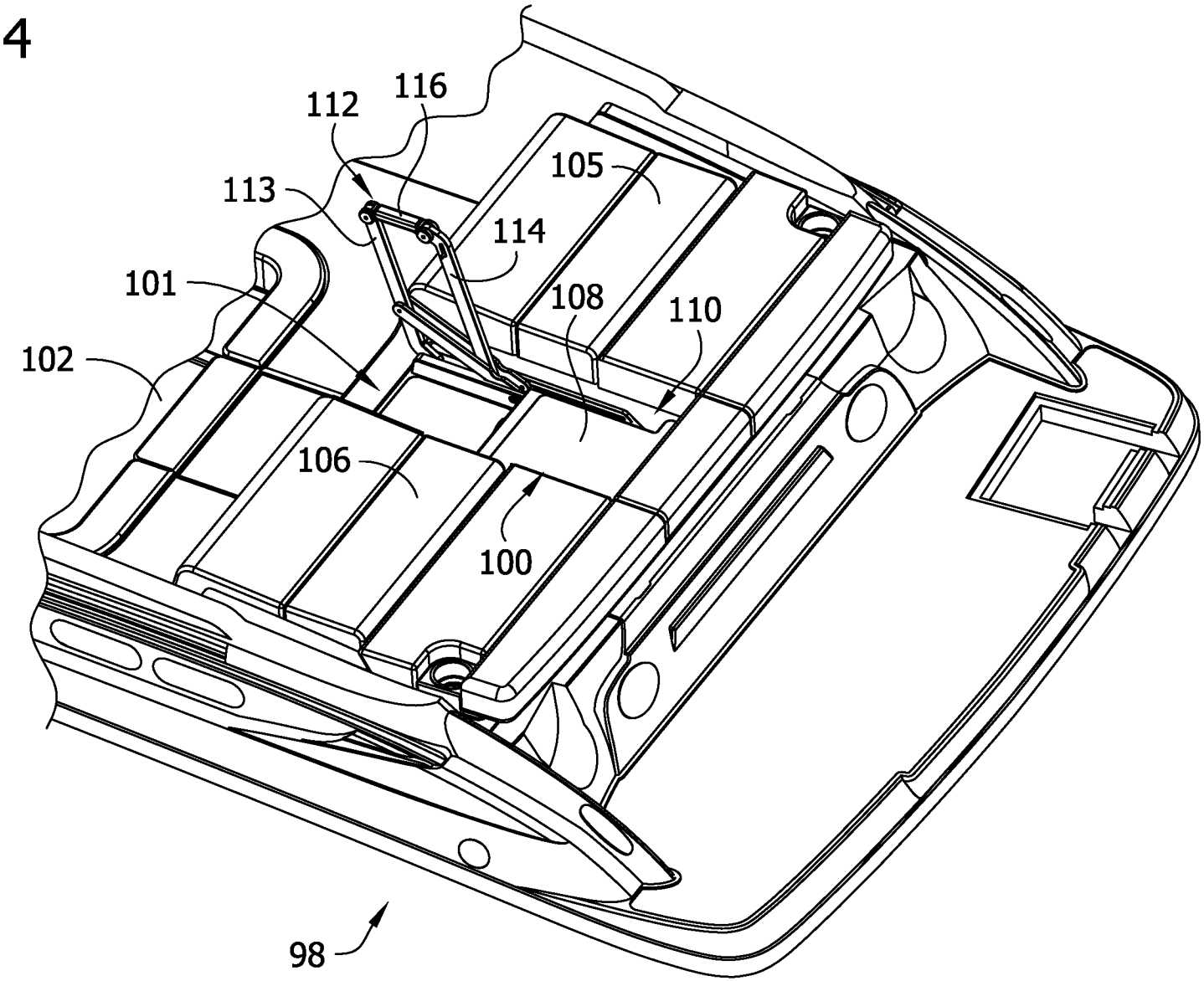
FIG. 4 is an enlarged perspective from a rear vantage of the stern of the boat showing the entryway assist railing in the deployed position.
Figure 5:
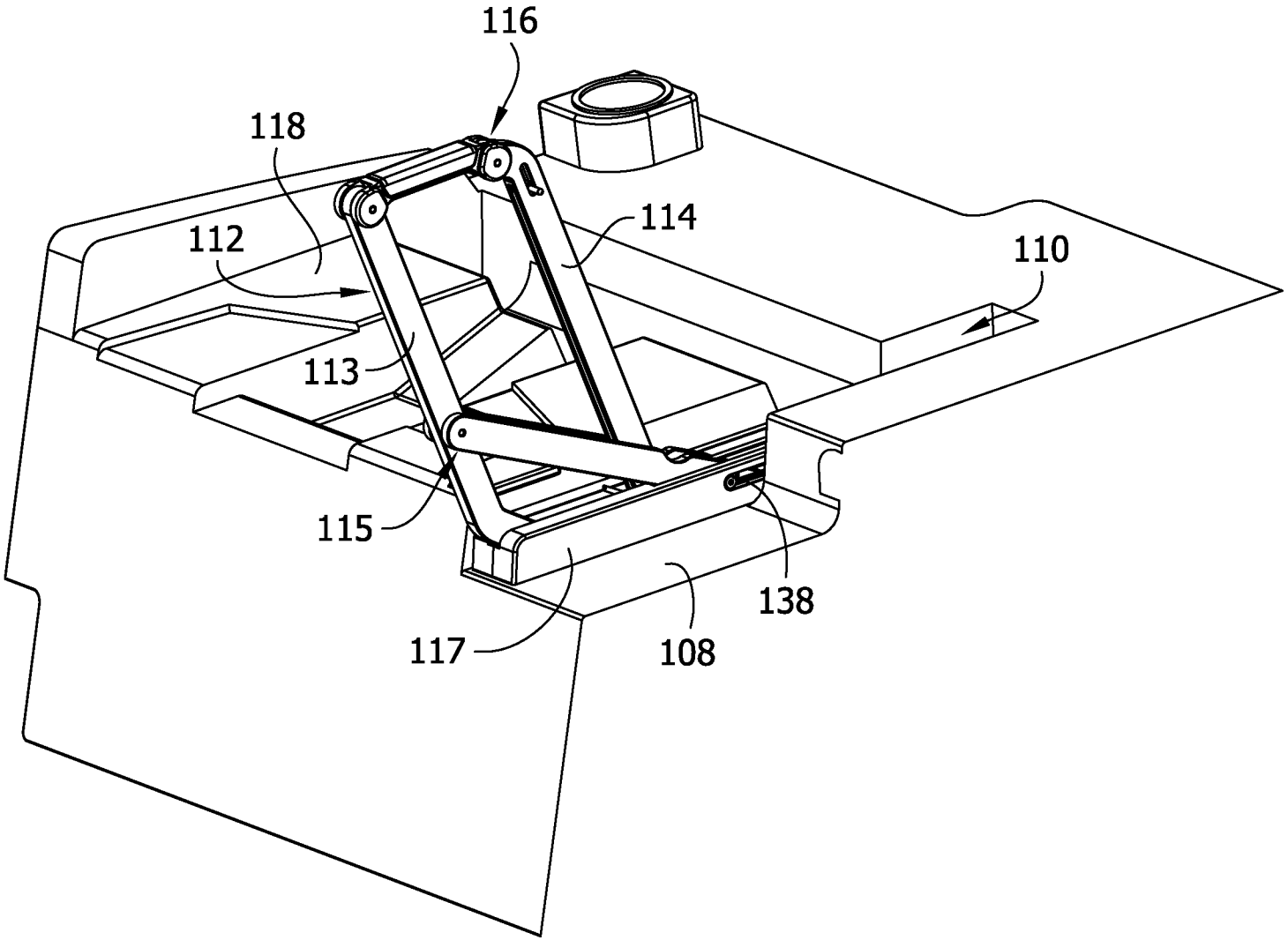
FIG. 5 is the perspective of FIG. 3, but showing the entryway assist railing in the deployed position.
Figure 6:
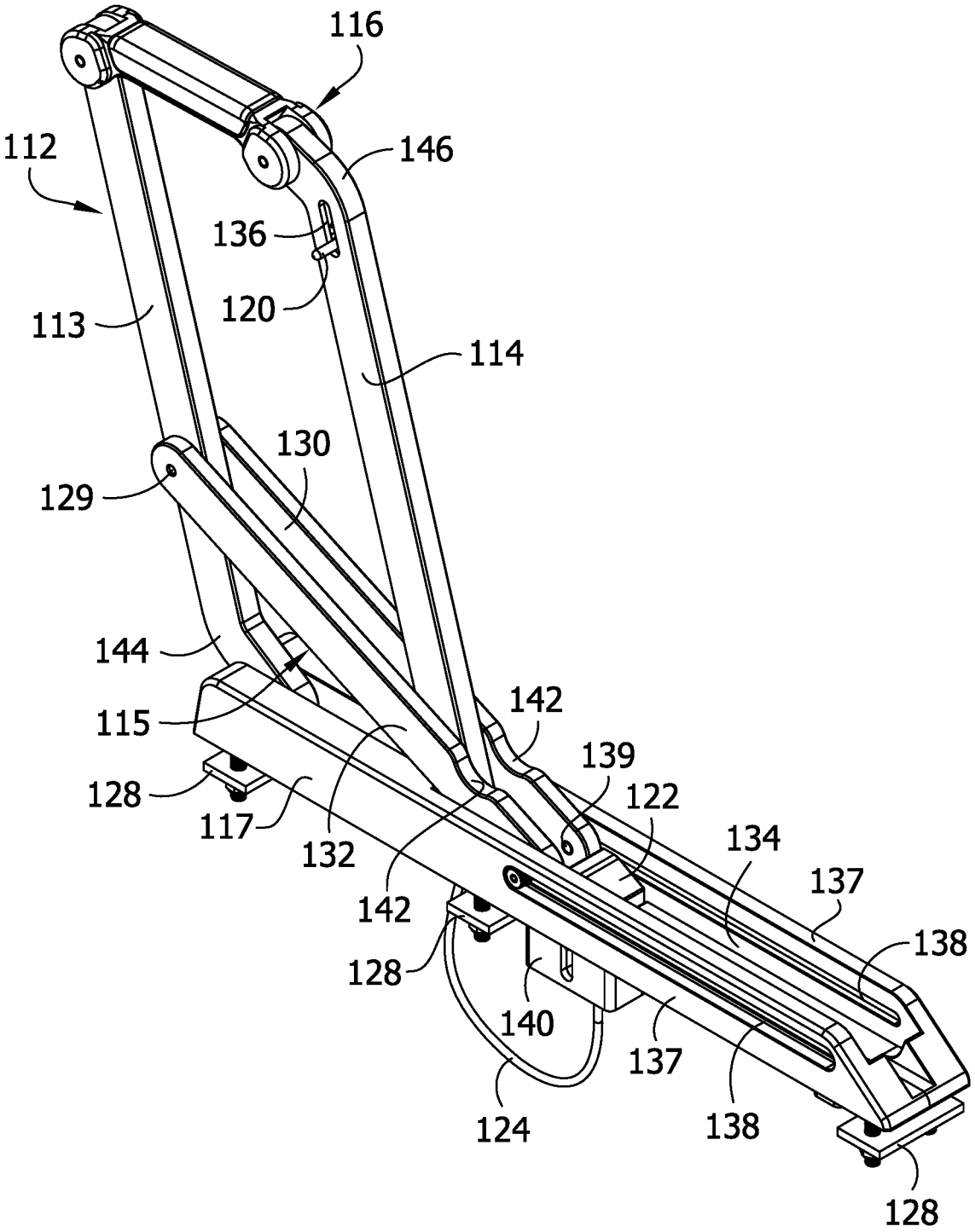
FIG. 6 is a perspective of the entryway assist railing in a deployed position.
Figure 7:
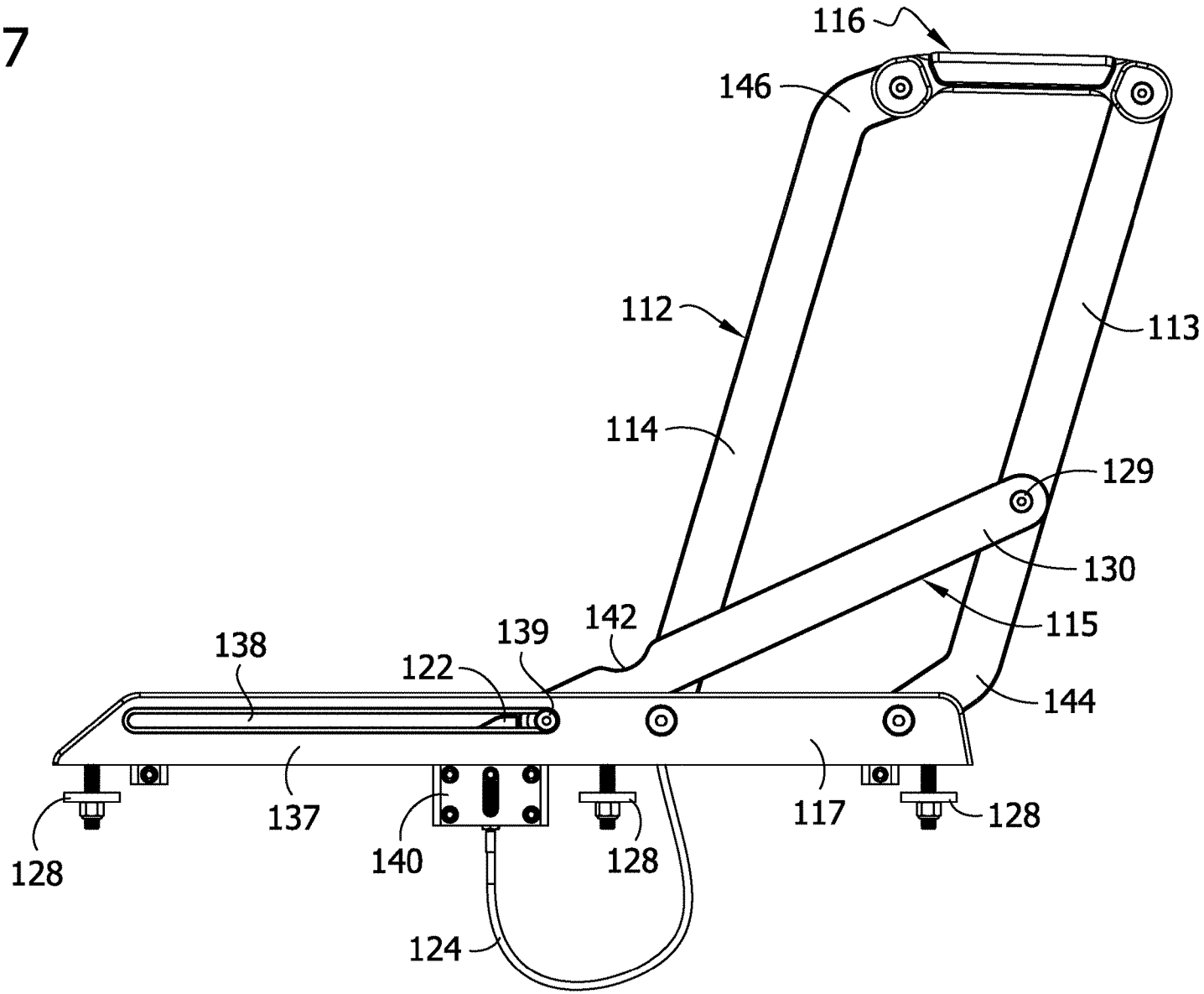
FIG. 7 is a left side view of the entryway assist railing in a deployed position.
Figure 8:
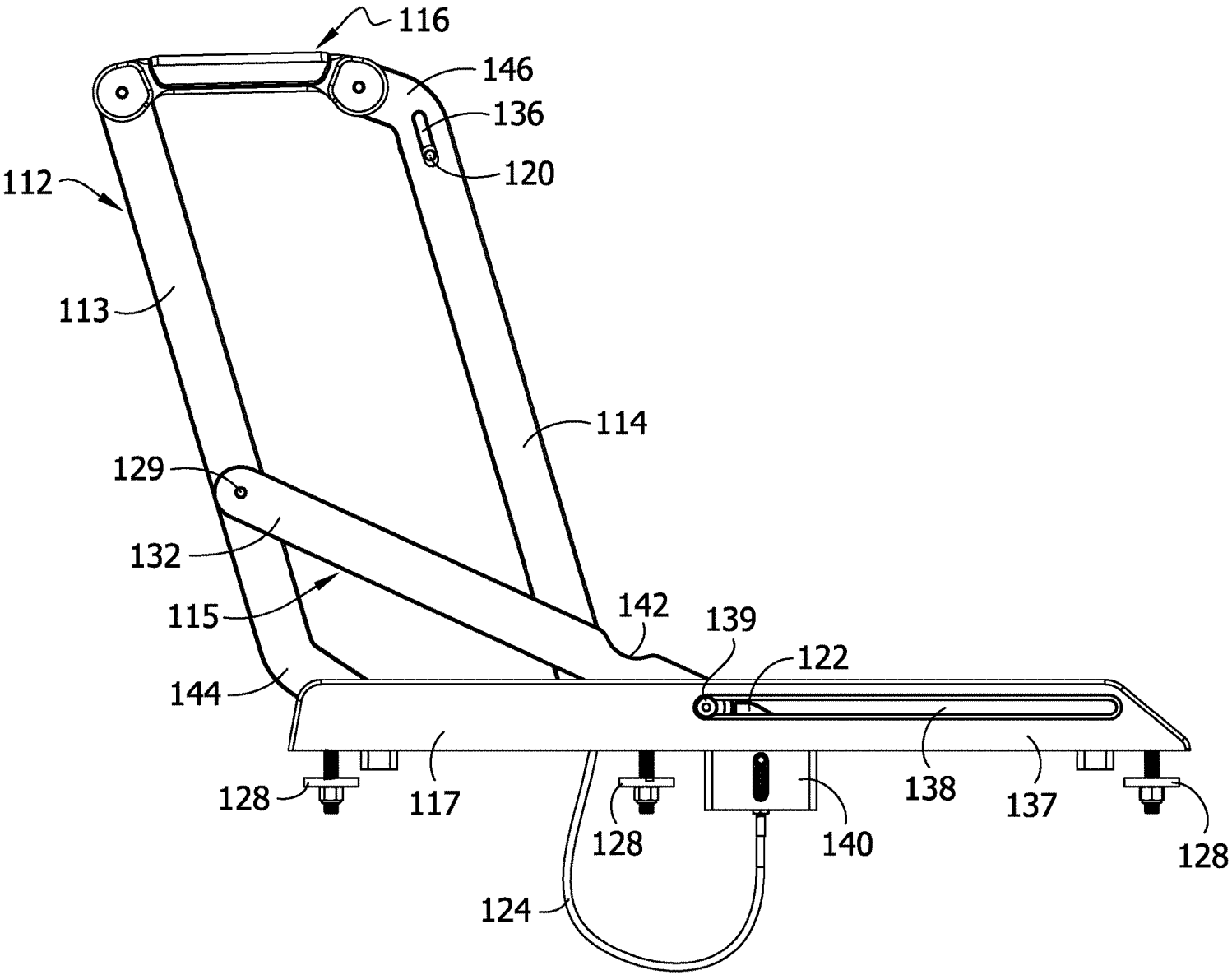
FIG. 8 is a right side view of the entryway assist railing in a deployed position.
Figure 9:
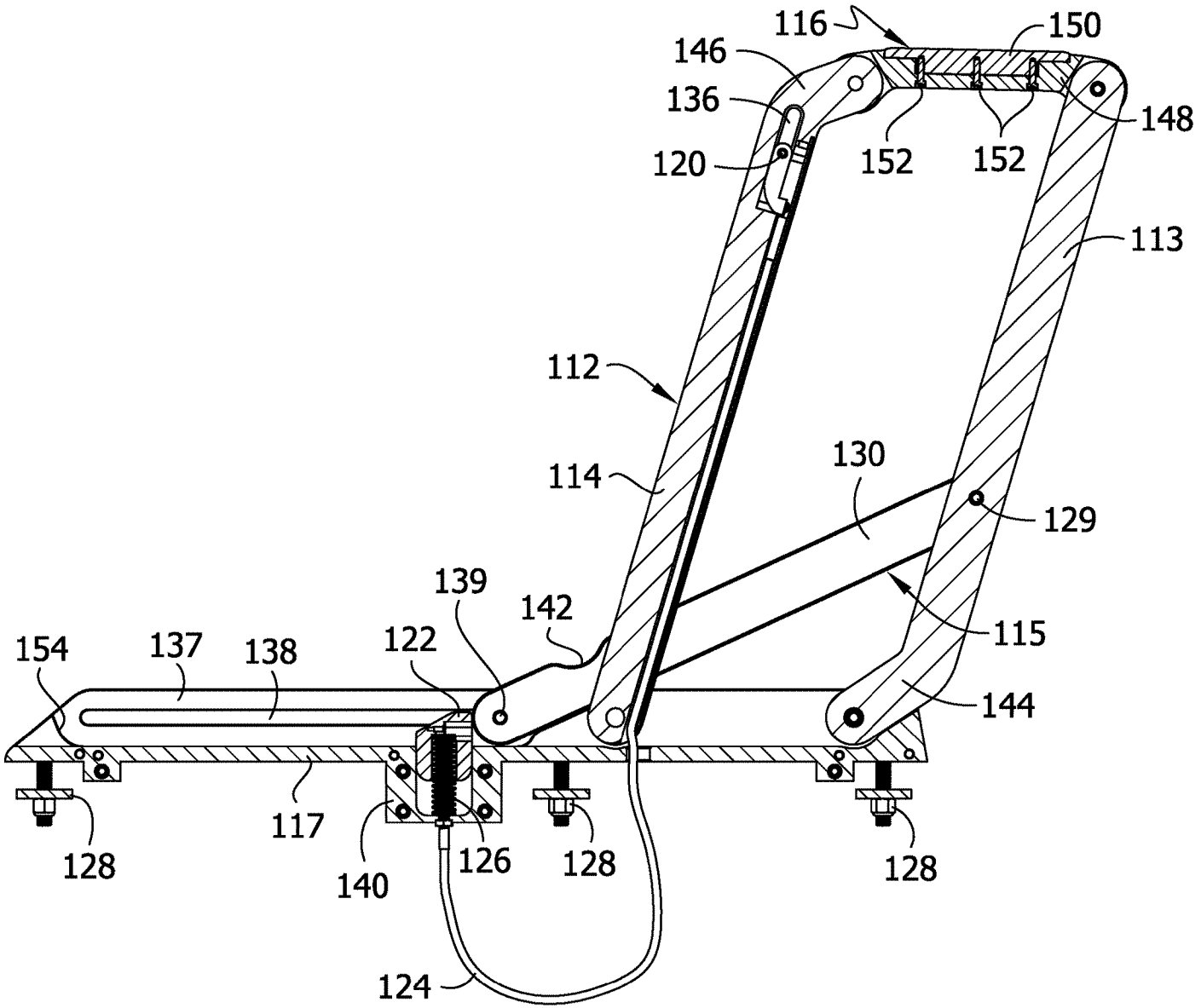
FIG. 9 is a vertical section of the entryway assist railing in a deployed position.
Figure 10:
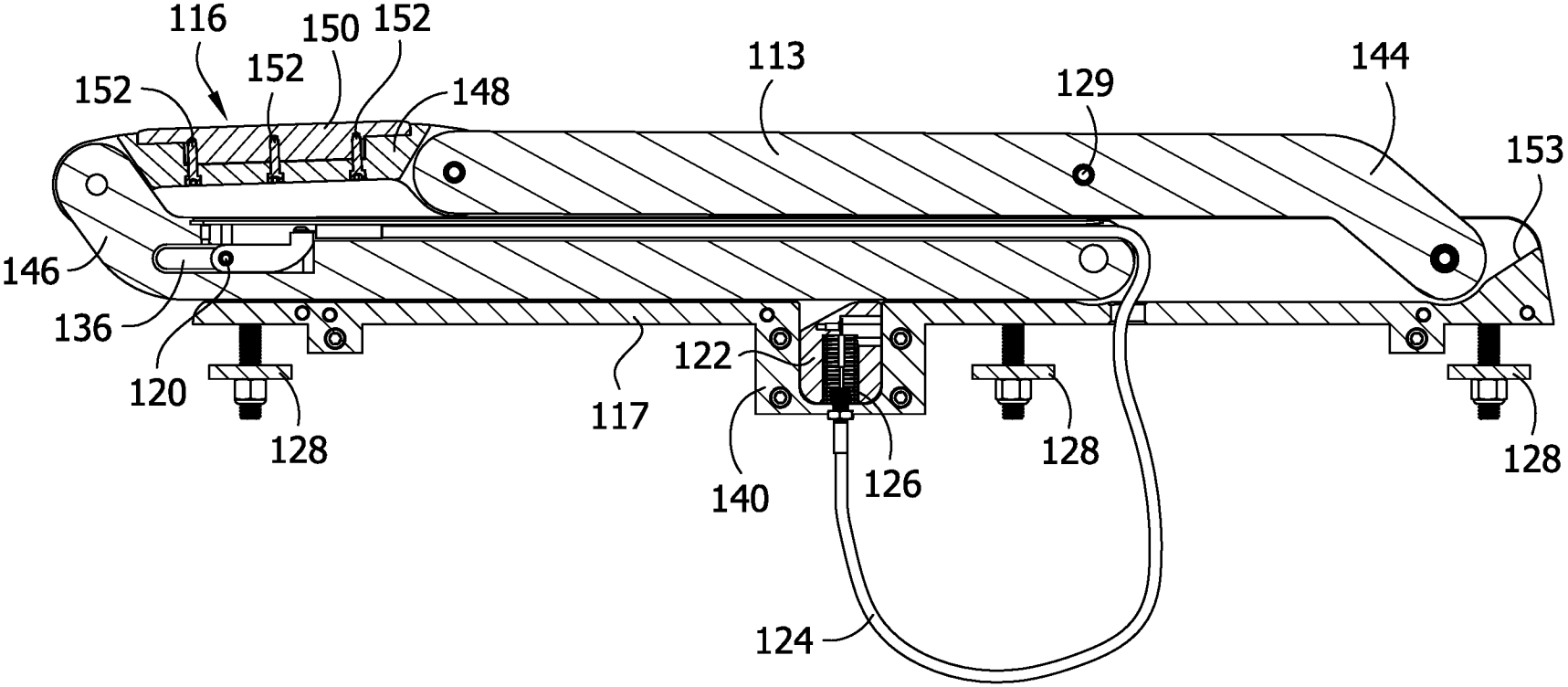
FIG. 10 is a vertical section of the entryway assist in a stowed position.

The fold down railing 112 can be moved from the stowed position (FIG. 3) to the deployed position (FIG. 4). In some instances, it may be necessary or desirable to move some or all of the shell covering (e.g., middle covering element 104) to expose the recess 110 and the fold down railing 112. The handle 116 (or other part of the railing 112) can be grasped within the recess 110 and moved upward and forward. The first and second balusters 113, 114 pivot upward and forward on their pivot connections with the channel 134. The brace 115 slides along the channel 134 in the slots 138 as it is pulled forward by its pivot connection to the first baluster 113. When the second end of the brace 115 reaches the stop 122, it engages the bevel shaped surface of the stop. The beveled shape of the stop 122 allows the movement of the brace 115 to drive the stop down into the stop housing 140. Once the brace clears the stop 122, the spring 126 rapidly drives the stop upward behind the second end of the brace 115. The railing 112 is now locked again in the deployed position. Moreover, the user can hear and feel a click or snap when the railing 112 reaches the deployed position to have assurance that the railing is now firmly in position for use.

In one embodiment of the present disclosure, the fold down railing 112 is coupled to the shell 101 by suitable fasteners projecting down from the base 117, such as bolts, nuts and washers indicated generally at 128. In another embodiment of the present disclosure, the fold down railing 112 is pivotally attached directly to the shell 101 by a pivot connection.

In the illustrated embodiment, the first and second balusters 113, 114 include angled portions 144 and 146, respectively. The angled portion 144 of the first baluster 113 is pivotally connected to the base 117. The angled portion 144 can rest against an upwardly sloping surface 153 of the channel 134 in the deployed position. This engagement helps to hold the railing 112 from over-pivoting in the forward direction. Over-pivoting is also resisted by the brace 115, which is connected to the first baluster 113 and engages a forward end of the slots 138 to resist such movement. An angled stop 154 is machined into the side walls 137 in order to stop the movement of the brace members 130, 132. The angled portion 146 of the second baluster 114 is configured to be connected to the handle 116 and allows for a space under the handle 116 when the railing 112 is in the stowed position to ease grasping of the handle to deploy. Additionally, in the illustrated embodiment the handle 116 comprises a handle base 148 and a grip 150. The grip 150 is secured to the handle base 148 through handle fasteners 152 (see, FIG. 9).

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A passage for a boat comprising:

a shell sized and shaped to cover at least a portion of the boat that is positioned to be traversed by passengers of the boat, the shell including a recess located formed in the shell;

a fold down railing comprising at least one baluster and a handle mounted on an end of the baluster, the baluster being pivotable with respect to the shell between a deployed position in which the baluster projects out of the recess and locates the handle above the shell in a position for grasping by a person walking on the boat, and a stowed position in which the baluster and handle are disposed in the recess.

2. The passage as in claim 1, wherein the baluster is entirely disposed in the recess in the stowed position.

3. The passage as in claim 2, wherein the handle is entirely disposed in the recess in the stowed position.

4. The passage as in claim 3, wherein the shell includes an upper surface, and no portion of the fold down railing projects above the upper surface of the shell in the stowed position.

5. The passage as in claim 4, wherein no portion of the handle projects above the upper surface of the shell in the stowed position of the fold down railing.

6. The passage as in claim 1, wherein the fold down railing is configured to be releasably retained in the deployed position.

7. The passage as in claim 6, wherein the fold down railing is configured to be releasably retained in the stowed position.

8. The passage as in claim 7, wherein the railing is movable from the deployed position to the stowed position through the application of force on the railing tending to move the railing from the deployed position to the stowed position in a first direction.

9. The passage as in claim 8, wherein the fold down railing is movable from the stowed position to the deployed position through the application of force on the fold down railing tending to move the fold down railing from the stowed position to the deployed position in a second direction.

10. The passage as in claim 1, wherein the fold down railing is pivotally attached to the shell.

11. The passage as in claim 10, wherein the baluster is pivotally connected to the handle.

12. The passage as in claim 11, wherein the fold down railing includes a second baluster parallel to the first baluster in the deployed position.

13. The passage as in claim 12, wherein the fold down railing further comprises a base and at least one brace that spans between the first baluster and the base.

14. The passage as in claim 13, wherein a first end of the brace is pivotally connected to the first baluster and a second end of the brace is pivotally connected to the base.

15. The passage as in claim 14, wherein the base further comprises a channel having side walls and slots in the side walls, the second pivot connection comprising a pin slidable along the channel slots to allow the fold down railing to be moved between the deployed position and the stowed position.

16. The passage as in claim 15, wherein the handle, first and second baluster of the fold down railing, and the base form a parallelogram shape in the deployed position.

17. The passage as in claim 13, wherein the brace is configured to receive a portion of the handle in the stowed position.

18. The passage as in claim 1 in combination with a boat.

19. A fold down railing for selective deployment to stabilize passage over a surface, the fold down railing comprising:

a base configured to be mounted on a boat, the base being channel-shaped;

a first baluster pivotally connected to the base at a first location;

a second baluster pivotally connected to the base at a second location spaced apart from the first location;

a handle pivotally connected at one end to the first baluster and at another end to the second baluster;

a brace pivotally connected to the first baluster at a first end and connected to the base at an opposite, second end for pivoting and sliding with respect to the base, the first baluster, second baluster and handle being selectively movable from a stowed position in which the handle is located close to the base and a deployed position in which the handle is farther from the base, the second end of the brace sliding along the base as the first baluster, second baluster and handle move between the stowed and deployed position; and a releasable stop for locking the brace against sliding movement along the base thereby to hold the first baluster, second baluster and handle in the deployed position.

20. The fold down railing as set forth in claim 19 wherein the stop and brace are configured so that as the brace moves from the stowed position to the deployed position the brace engages the stop to temporarily deflect the stop out of the way of the brace.

* * * * *